US011484939B2

(12) United States Patent
Schwarz

(10) Patent No.: US 11,484,939 B2
(45) Date of Patent: Nov. 1, 2022

(54) VENTING DEVICE FOR VENTING A CASTING MOLD HAVING A SAW-TOOTHED GAP

(71) Applicants: InterGuss Gießereiprodukte GmbH, Bad Windsheim (DE); MFSA Modell-und Formenbau GmbH Sachsen-Anhalt, Magdeburg (DE)

(72) Inventor: Carolin Schwarz, Neckarsulm (DE)

(73) Assignees: INTERGUSS GIESSEREIPRODUKTE GMBH, Bad Windsheim (DE); MFSA MODELL-UND FORMENBAU GMBH, Magdeburg (DE)

( * ) Notice: Subject to any disclaimer, the term of this patent is extended or adjusted under 35 U.S.C. 154(b) by 130 days.

(21) Appl. No.: 17/075,170

(22) Filed: Oct. 20, 2020

(65) Prior Publication Data

US 2021/0170477 A1 Jun. 10, 2021

(30) Foreign Application Priority Data

Dec. 6, 2019 (DE) ..... 10 2019 133 354.7

(51) Int. Cl.
*B22D 17/14* (2006.01)
*B22C 9/06* (2006.01)

(52) U.S. Cl.
CPC ..... *B22D 17/145* (2013.01); *B22C 9/067* (2013.01)

(58) Field of Classification Search
CPC ..... B22D 17/145; B22C 9/067
USPC ..... 164/305, 372, 410
See application file for complete search history.

(56) References Cited

U.S. PATENT DOCUMENTS

| | | | | |
|---|---|---|---|---|
| 4,154,285 | A | 5/1979 | Yamasaki | |
| 2008/0041550 | A1 | 2/2008 | Wang | |
| 2010/0276107 | A1* | 11/2010 | Gauermann | B22C 9/067 164/253 |
| 2014/0196864 | A1* | 7/2014 | Werner | B22C 9/067 164/410 |
| 2021/0129213 | A1* | 5/2021 | Jung | B22D 17/2015 |

FOREIGN PATENT DOCUMENTS

| | | | |
|---|---|---|---|
| DE | 20208464 | U1 | 11/2002 |
| DE | 20313259 | U1 | 1/2004 |
| DE | 69814023 | T2 | 4/2004 |

(Continued)

*Primary Examiner* — Kevin E Yoon
*Assistant Examiner* — Jacky Yuen
(74) *Attorney, Agent, or Firm* — Quarles & Brady LLP

(57) ABSTRACT

A venting device for venting a casting mold in the form of a chill vent having two mold halves which oppose each other and are complementary to each other in form and function, each mold half having a plurality of elevations and indentations in the areas facing each other and the elevations of one mold half engaging with the indentations of the second mold half, and a gap being formed between the two mold halves when the mold halves are placed on each other, air and surplus molten material flowing out through said gap when the casting mold is being filled, the gap having, in the flow direction of the molten material, a saw-toothed course having several sawtooth portions disposed in a row in the flow direction, each sawtooth portion having a leading edge inclined in the flow direction and a trailing edge inclined against the flow direction.

9 Claims, 8 Drawing Sheets

(56) References Cited

FOREIGN PATENT DOCUMENTS

| | | | |
|---|---|---|---|
| DE | 102007007520 | A1 | 8/2008 |
| EP | 0930114 | B1 | 7/1999 |
| WO | 2013127386 | A1 | 9/2013 |

* cited by examiner

VENTING DEVICE FOR VENTING A CASTING MOLD HAVING A SAW-TOOTHED GAP

CROSS-REFERENCE TO RELATED APPLICATIONS

This application claims priority to German Patent Application No. 10 2019 133 354.7 filed on Dec. 6, 2019, which is incorporated herein by reference in its entirety for all purposes.

The disclosure relates to a venting device for venting a casting mold according to the preamble of claim 1.

When filling a casting mold, whether it be in high-pressure or low-pressure die casting, in permanent mold casting or in any other casting process, the air present in the mold has to be removed from said mold in order to achieve a neat casting result without blowholes and porosity. This can either be carried out actively by evacuating the mold before the actual filling process starts or passively by displacing the air when introducing the casting material or by combining the two methods.

For this purpose, the casting mold usually has a valve means which can be closed after the mold has been vented completely. In order to guarantee a permanent functioning of such valve means, it has to be ensured that no casting material flows from the mold into the area of the valve means since this normally results in the destruction of the valve means such that said valve means has to be exchanged afterward. This involves high personnel input and the corresponding costs.

From document DE 202 08 464 U1 a valve means in the form of a so-called chill vent is known. In this valve means the mold is vented by means of a labyrinthine or washboard-like gap in a block-like valve body made of a highly thermally conductive material, casting material entering the gap and freezing there after the air has been removed from the casting mold. This ensures that a majority of the air is removed from the mold and a satisfactory result is achieved.

Due to the labyrinthine or washboard-like gap, the demolding of the known chill vents has so far been possible only orthogonally to the parting line of the venting device. In order to be able to remove the solidified casting material from the opened chill vent, one of the two mold halves of the chill vent has to have an ejector which presses the solidified casting material orthogonally out of the corresponding mold half, in particular when said mold half is covered by a slide. The ejecting of the solidified casting material from the corresponding half of the chill vent is in particular necessary in the case where the chill vent is installed in a slide of the casting mold. This is due to the fact that the slide has to be moved out of the casting mold linearly when the cast body is demolded from the casting mold, which so far has not been possible in the known chill vents because of the labyrinthine or washboard-like gap.

The object of the disclosure at hand is therefore to propose a new venting device in the form of a chill vent which avoids the disadvantages described above. In particular, the installation of ejectors in the chill vent is to be avoided and the installation of the chill vent with one mold half in slides of casting molds is to be made possible. This object is attained by a venting device according to the teachings of claim 1.

Advantageous embodiments of the disclosure are the subject matter of the dependent claims.

The venting device according to the disclosure is characterized by the gap formed between the two mold halves of the chill vent. According to the disclosure, said gap is realized in a saw-toothed manner and has several sawtooth portions disposed in a row in the flow direction. Each sawtooth portion on its part has a leading edge inclined in the flow direction and a trailing edge inclined against the flow direction. Due to the fact that the sawtooth portions are formed with leading edges and trailing edges, the solidified casting material can be demolded from the opened chill vent after the mold has been filled without using further auxiliary means. The saw-toothed course of the gap, in particular, facilitates an opening of the mold and a simultaneous outward movement of a slide, at least one mold half of the chill vent being installed in the slide. The leading edges and the trailing edges of the saw-toothed course make it possible that the solidified casting material is pressed out transversely to the mold parting line of the two mold halves by moving the slide, without having to install an ejector in the chill vent for this purpose.

It is particularly advantageous if the leading edges of the sawtooth portions are inclined with an inclination angle, which is smaller than the self-locking angle of the material pair composed of the solidified material in the gap and the material of the mold halves, with respect to the mold parting line of the two mold halves in order to not impede the pressing of the solidified casting material out of the opened chill vent by self-locking. This makes it possible that, when moving the slide along the mold parting line, the relative movement between the solidified material in the gap and the material of the mold halves resulting therefrom is not impeded or precluded by static friction.

For common material pairs composed of the solidified material in the gap and the material of the mold halves, an inclination angle of the leading edges, which is smaller than or equal to 45 degrees, is suitable.

An inclination angle of the leading edges of the sawtooth portions, which is smaller than or equal to 35 degrees, is particularly advantageous.

It is particularly advantageous if the inclination angle of the leading edges of all sawtooth portions is chosen to be of the same size in order to preclude any, even if only local, obstruction of the actuating movement of a slide due to excessive friction.

With regard to the easy demolding of the solidified material from the opened chill vent, it is, furthermore, particularly advantageous if the trailing edges of the sawtooth portions are inclined with an inclination angle, which is greater than 70 degrees, with respect to the mold parting line of the two mold halves. In particular, the inclination angle of the trailing edges is to be chosen between 80 degrees and 90 degrees. With regard to the trailing edges it is just as advantageous as with regard to the leading edges if the inclination angle of the trailing edges of all sawtooth portions is of the same size.

With regard to the extension of the gap in the venting device and in order to additionally achieve an easier demolding of the solidified casting material, it is provided according to a preferred embodiment that the sawtooth portions are disposed in a row along an arc which extends transversely to the flow direction through the venting device. The venting device according to the disclosure is of particularly great importance when one mold half of the venting device is installed in a slide of the casting mold and is, thus, drivable parallel to the mold parting line of the two mold halves.

An embodiment of the disclosure is schematically illustrated in the drawings and is exemplified below.

Figure 1:
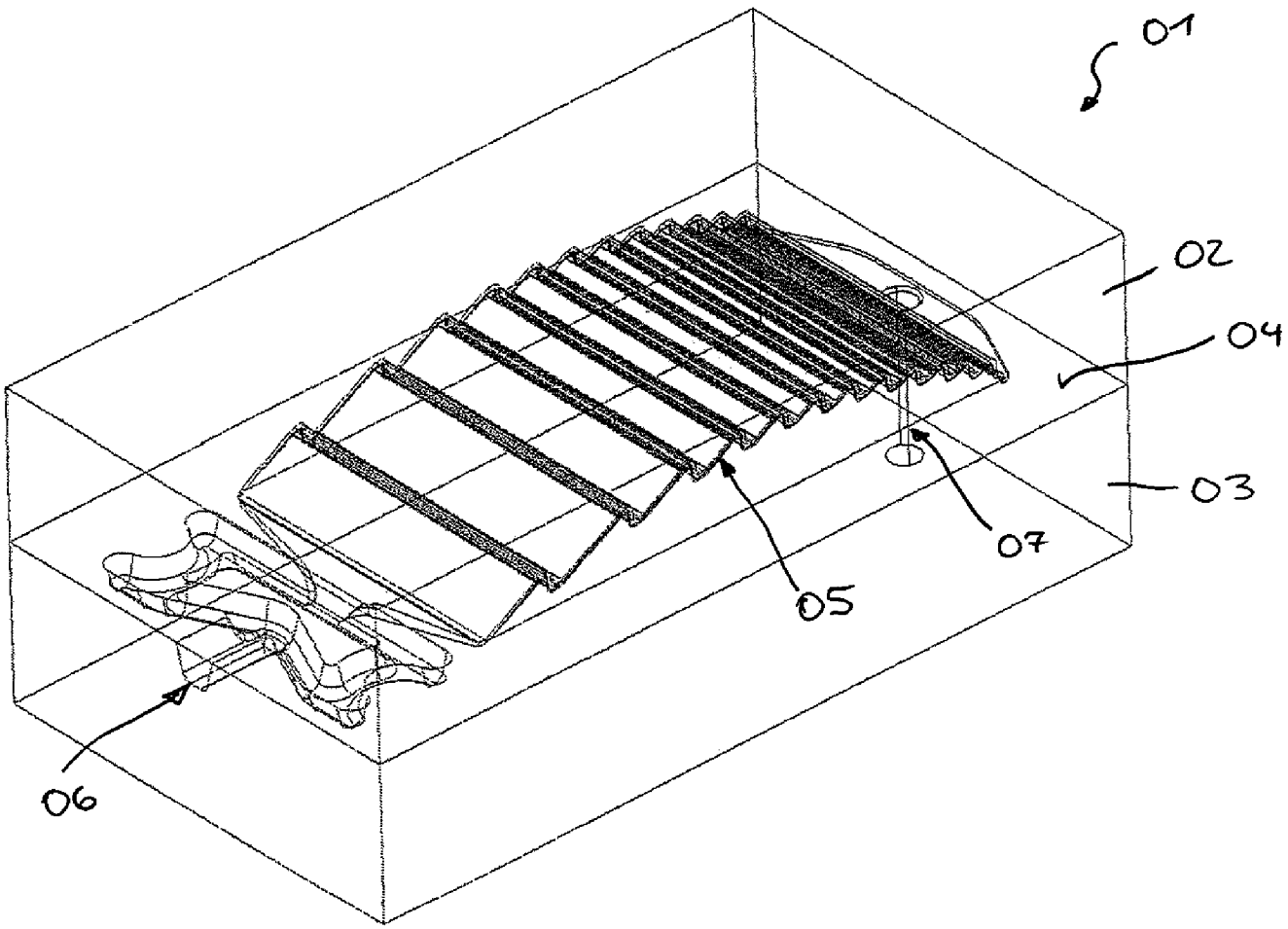
FIG. 1 shows a perspective lateral view of a venting device according to the disclosure.

FIG. 1 shows a venting device 01 having an upper mold half 02 and a lower mold half 03. The two mold halves 02 and 03 can be put together in a mold parting line 04, elevations and indentations in the two mold halves 02 and 03 forming a gap 05. If the venting device 01 is filled with molten material through a channel 06, the air present in the gap 05 can escape out of the venting device 01 through a channel 07. After that, the gap 05 fills with the molten material which solidifies there and closes the venting device 01 in this manner.

Figure 2:
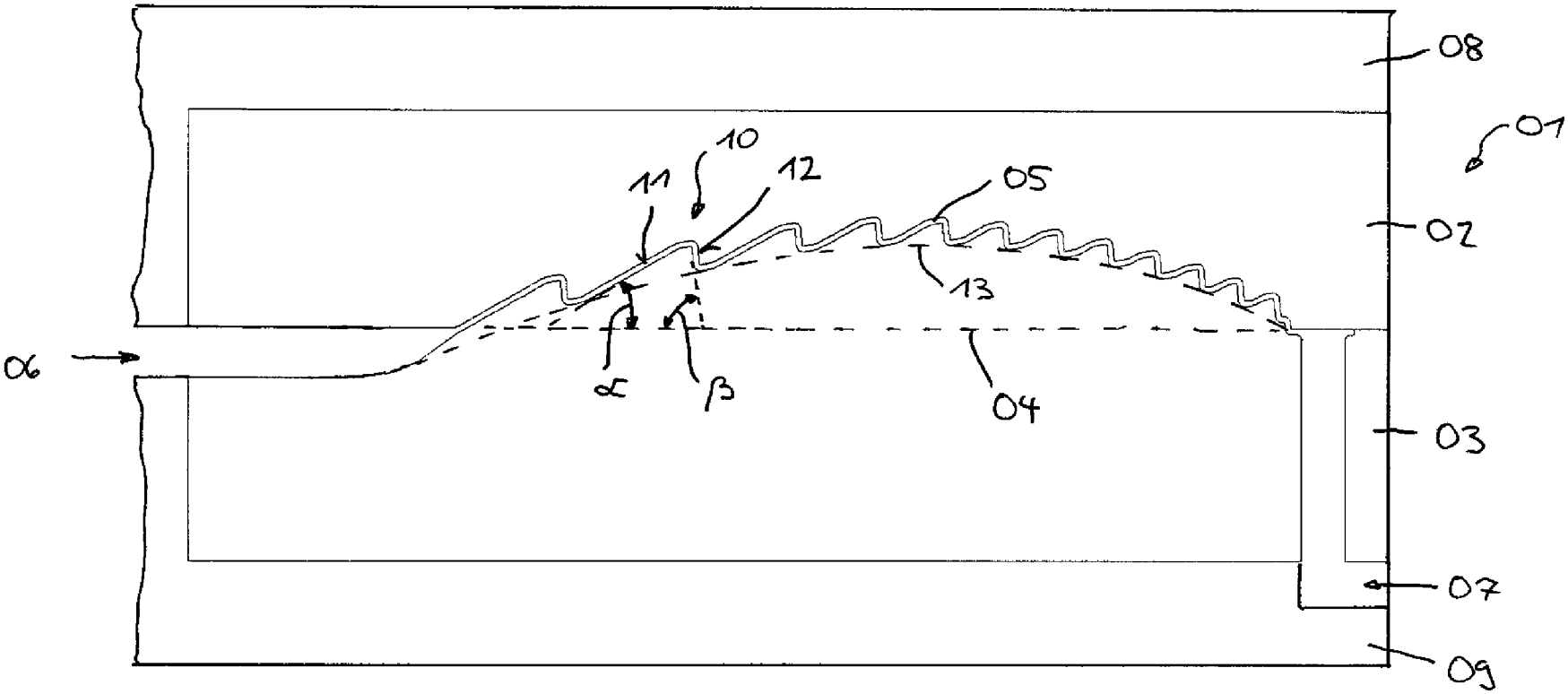
FIG. 2 shows a longitudinal section of the venting device according to FIG. 1 before it is filled with molten material.

FIG. 2 shows the venting device 01 having the two mold halves 02 and 03 after said mold halves 02 and 03 have been installed in the mold halves 08 and 09 of a casting mold, which are only partially illustrated. It can be seen that the gap 05 has a saw-toothed course which is formed by several sawtooth portions 10 disposed in a row in the flow direction. Each sawtooth portion 10 has a leading edge 11 and a trailing edge 12. The leading edges 11 are inclined with an inclination angle ($\alpha$) in the flow direction. The trailing edges 12 are inclined with an inclination angle ($\beta$) against the flow direction.

In the venting device 01 the inclination angle ($\alpha$) is 34 degrees. This inclination angle of 34 degrees, thus, is smaller than the self-locking angle of the material pair composed of the material to be processed in the venting device 01 and the material which is used for producing the two mold halves 02 and 03. Furthermore, it can be seen in FIG. 2 that the inclination angles ($\alpha$) and ($\beta$) are of the same size at all sawtooth portions 10, that is all sawtooth portions 10 have an inclination angle ($\alpha$) of 30 degrees and an inclination angle ($\beta$) of 80 degrees. In order to be able to dispose as many sawtooth portions 10 as possible along the gap 05 within the venting device 01, the sawtooth portions 10 are disposed along an arc 13 which is hinted at in FIG. 2 with a dashed line. Furthermore, by means of the arc-shaped arrangement of the sawtooth portions 10, an easier demolding is achieved since there is pressure on all edges only in the first moment of the demolding. After only a short movement of the slide, the solidified molten mass starts to move out/bend out of the mold in such a manner that fewer and fewer sawtooth portions 10 are in mesh. The large sawtooth portion 10 at the very front bears the main load. Thereby, the friction is reduced and, thus, the resistance which counteracts demolding is reduced.

Figure 3:
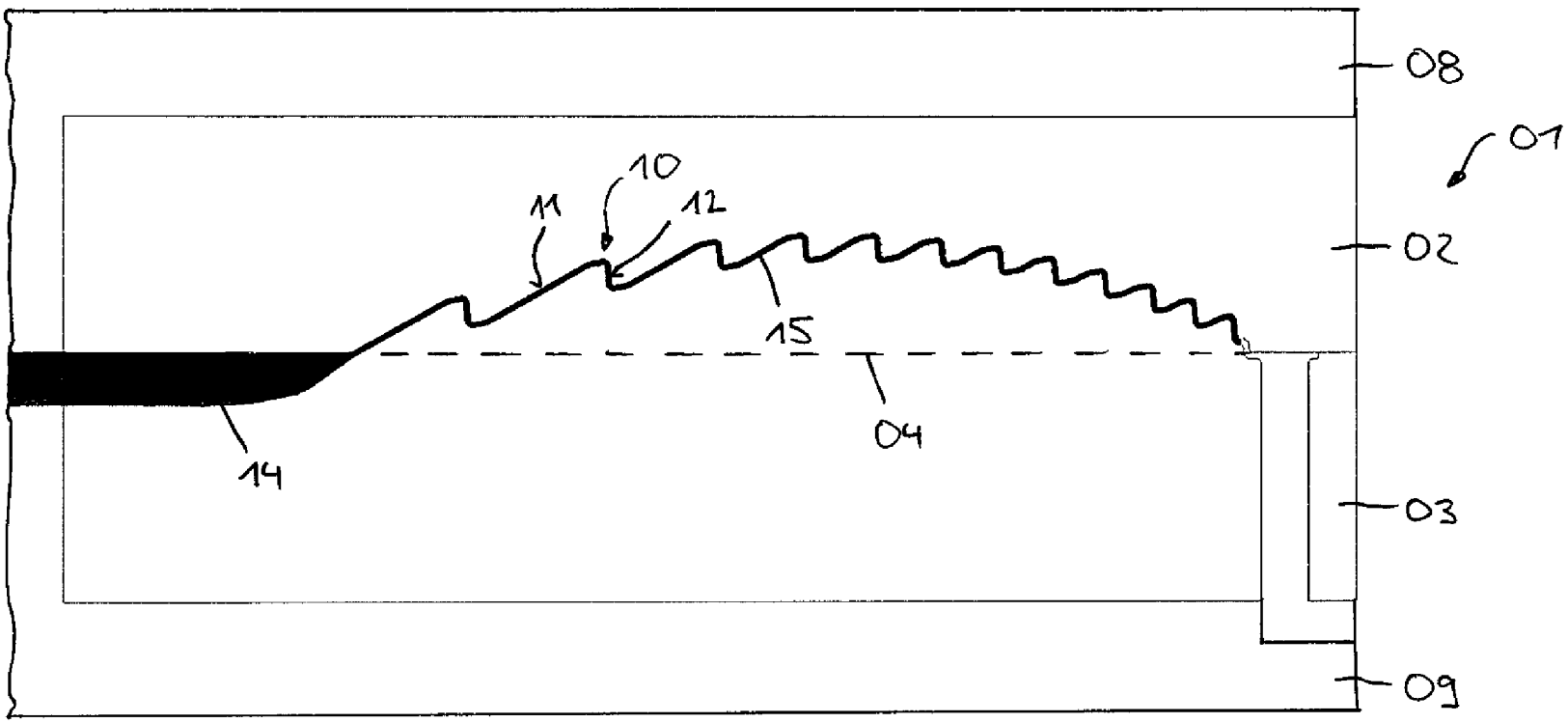
FIG. 3 shows the venting device according to FIG. 1 after it has been filled with molten material.

FIG. 3 shows the venting device 01 after the casting mold formed by the mold halves 08 and 09 has been filled with a molten material 14. By the solidification of the molten material 14, a sprue 15 is produced within the venting device 01. Due to the design of the gap 05, the sprue 15 receives a saw-toothed course having several sawtooth portions 10.

Figure 4:
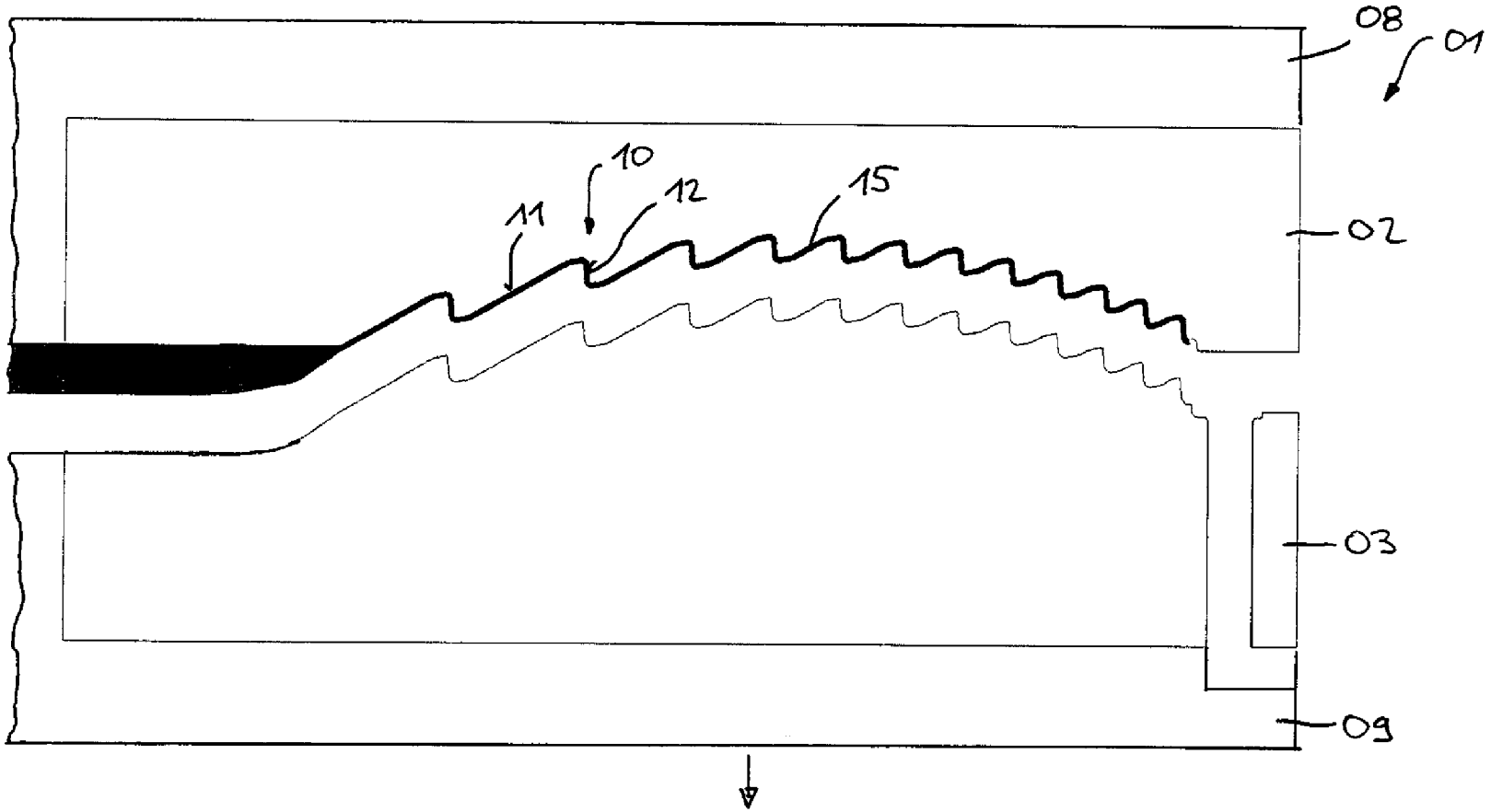
FIG. 4 shows the venting device according to FIG. 3 after the two mold halves have been opened.

FIG. 4 shows the venting device 01 after the casting mold formed by the mold halves 08 and 09 has been opened. The sprue 15 remains in the upper mold half 02 as soon as the lower mold half 03 together with the mold half 09 of the casting mold has been opened.

Figure 5:
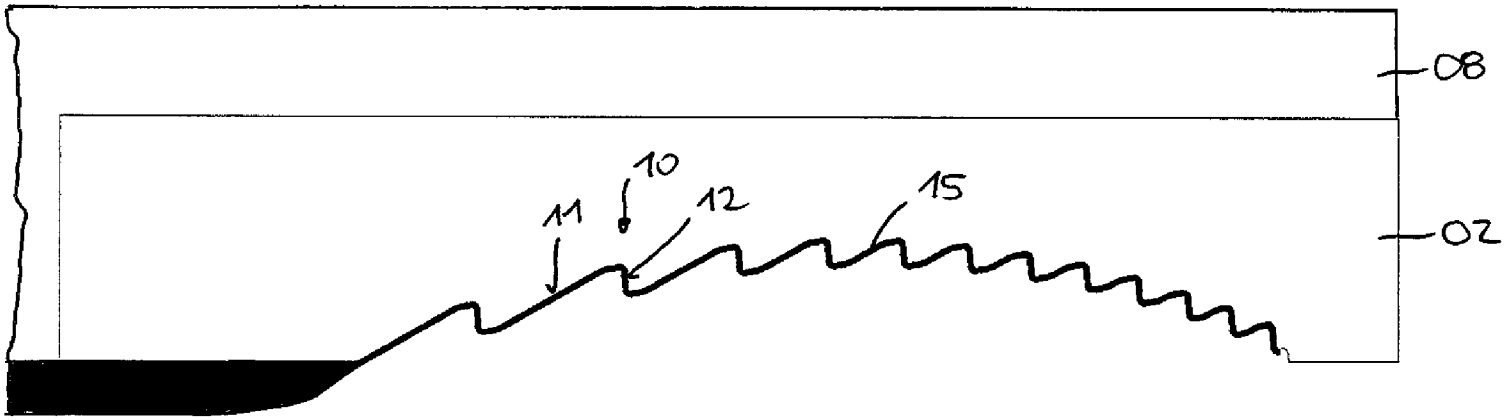
FIG. 5 shows the upper mold half of the venting device according to FIG. 4 after the venting device has been opened.

FIG. 5 shows the sprue 15 after the lower mold half 03 has been removed. In the embodiment shown in FIGS. 1 to 7, it is provided that the upper half 02 of the venting device 01 can be moved parallel to the mold parting line 04 of the two mold halves 02 and 03 and, thus, forms a slide in the casting mold formed by the mold halves 08 and 09.

Figure 6:
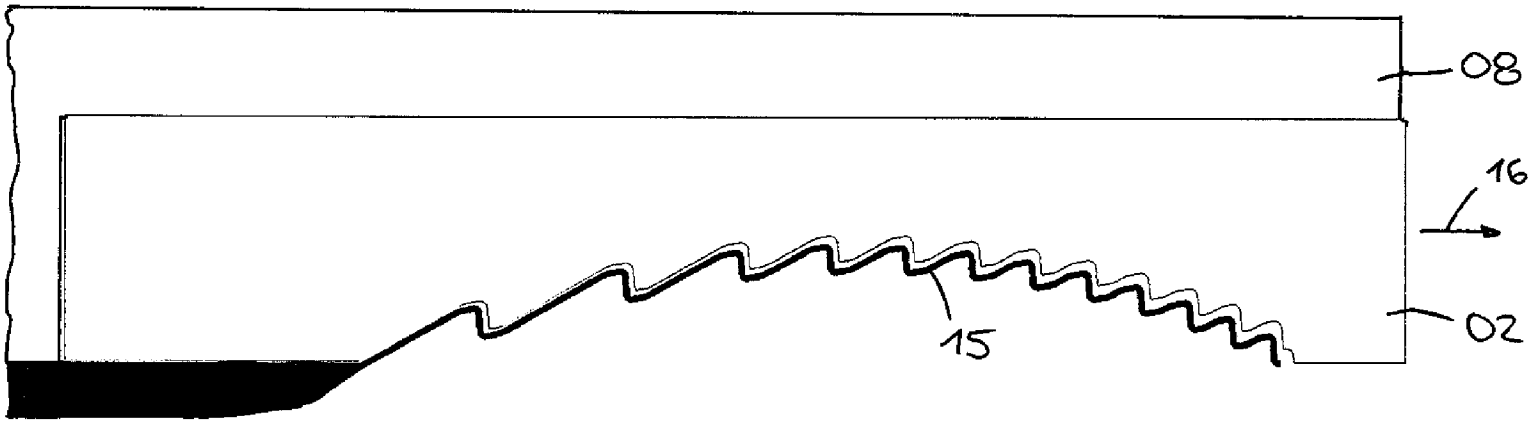
FIG. 6 shows the upper mold half of the venting device according to FIG. 5 after a slide has started to move outward.

FIG. 6 shows the upper mold half 02 after it has partly been moved out of the mold half 08 parallel to the mold parting line 04 in the direction of the arrow 16. The saw-toothed course of the sprue 15 guarantees that the sprue 15 is pressed out of the mold half 02 transversely to the gap 05 when the upper mold half 02 is moved with respect to the mold half 08. For this, an additional ejector is not necessary. Rather, the ejecting movement is realized by the geometry of the gap 05 and the geometry of the sprue 15 produced thereby.

Figure 7:
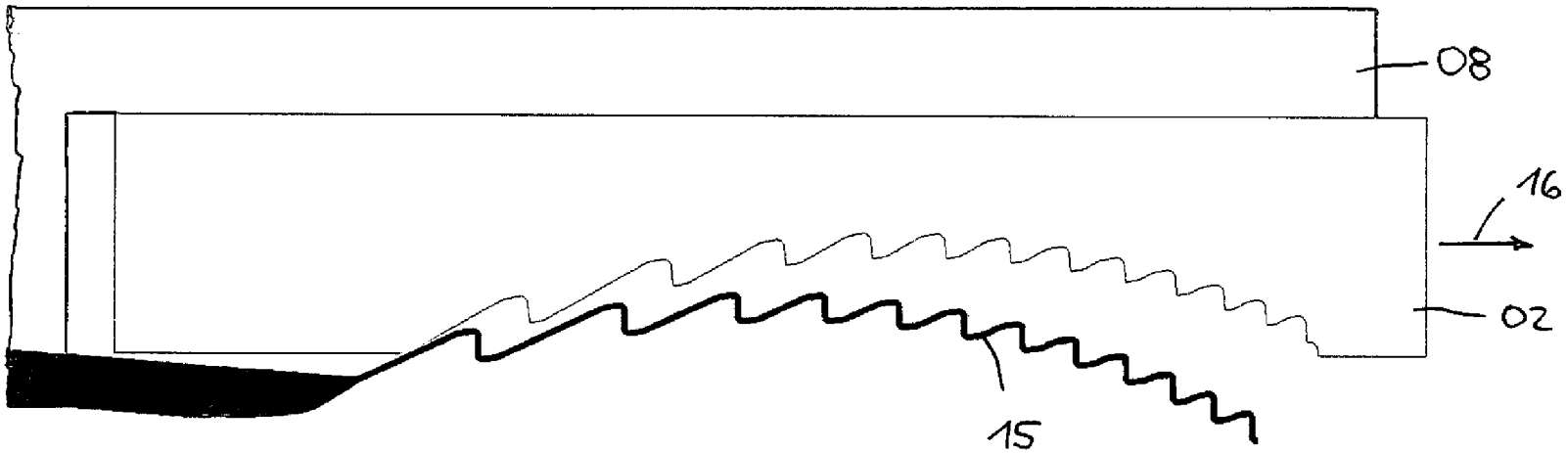
FIG. 7 shows the upper mold half of the venting device according to FIG. 6 at the end of the outward movement of the slide.

FIG. 7 shows the sprue 15 after it has been essentially completely demolded from the upper mold half 02. After that, the workpiece together with the sprue 15 can be demolded and can be further processed.

Figure 8:
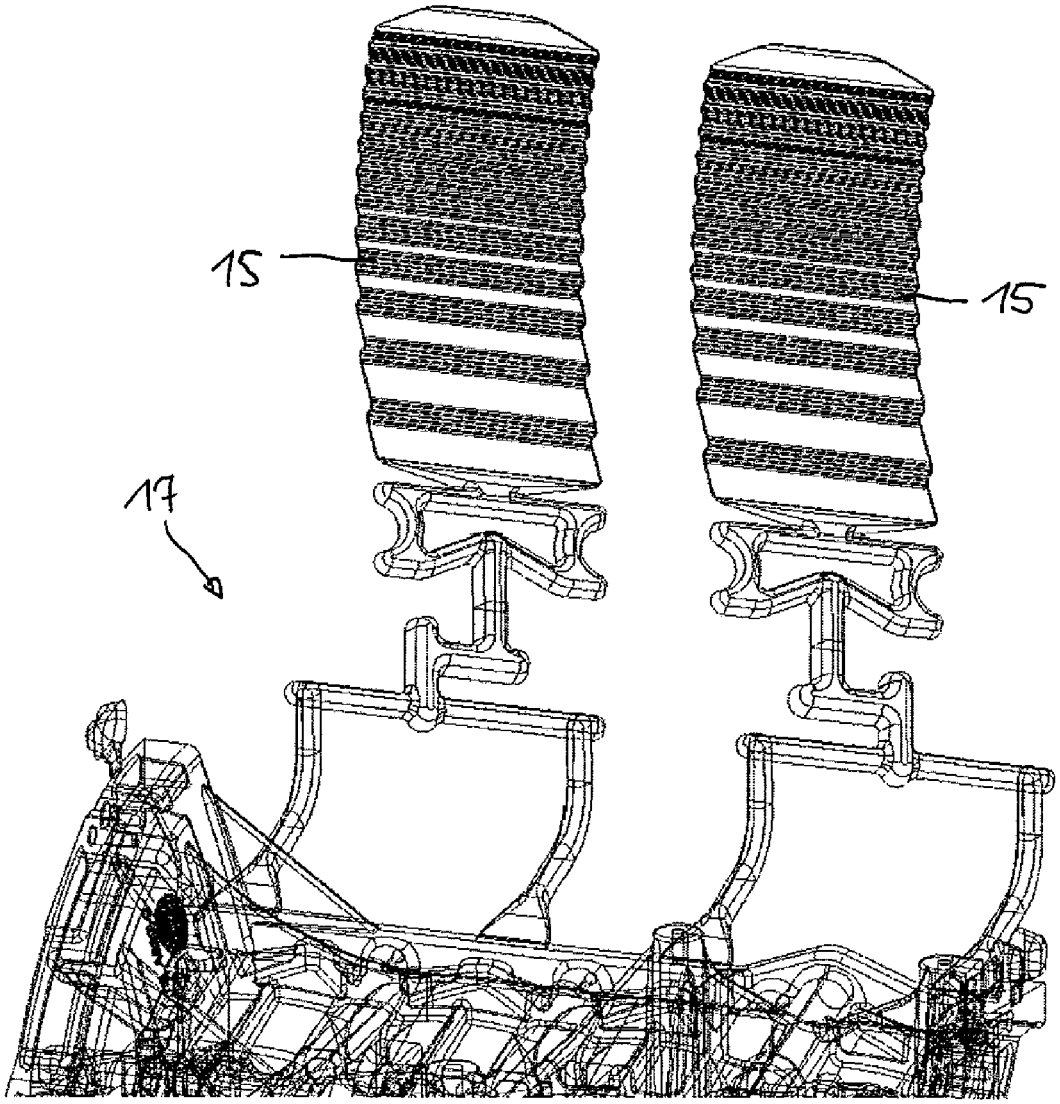
FIG. 8 shows a cast part having two sprues, each of which has been produced by means of a venting device according to FIG. 1.

FIG. 8 exemplarily shows a workpiece 17 which has been produced in a casting mold having two venting devices 01. After the demolding of the workpiece 17, two sprues 15 having an arcuate saw-toothed course have formed at the end of the casting channels, said sprues 15 having to be cut off before the workpiece 17 is further processed.

The invention claimed is:

1. A venting device for venting a casting mold in the form of a chill vent having two mold halves which oppose each other and are complementary to each other in form and function, each mold half having a plurality of elevations and indentations in their areas facing each other and the elevations of one mold half engaging with the indentations of the second mold half, and a gap being formed between the two mold halves when the mold halves are placed on each other, air and surplus molten material flowing out through said gap when the casting mold is being filled, wherein the gap has, in the flow direction of the molten material, a saw-toothed course having several sawtooth portions disposed in a row in the flow direction, each sawtooth portion having a leading edge inclined in the flow direction and a trailing edge inclined against the flow direction, and wherein the sawtooth portions are disposed in a row along an arc.

2. The venting device according to claim 1, wherein the leading edges of the sawtooth portions are inclined with an inclination angle ($\alpha$), which is smaller than a self-locking angle of the material pair composed of a solidified material in the gap and the material of the mold halves, with respect to a mold parting line of the two mold halves.

3. The venting device according to claim 1, wherein an inclination angle ($\alpha$) of the leading edges of the sawtooth portions is smaller than or equal to 45 degrees.

4. The venting device according to claim 3, wherein the inclination angle ($\alpha$) of the leading edges of the sawtooth portions is smaller than or equal to 35 degrees.

5. The venting device according to claim 1, wherein an inclination angle ($\alpha$) of the leading edges of all sawtooth portions is of the same size.

6. The venting device according to claim 1, wherein the trailing edges of the sawtooth portions are inclined with an inclination angle (β), which is greater than 70 degrees, with respect to a mold parting line of the two mold halves.

7. The venting device according to claim 6, wherein the inclination angle (β) of the trailing edges of the sawtooth portions is between 80 degrees and 90 degrees.

8. The venting device according to claim 1, wherein an inclination angle (β) of the trailing edges of all sawtooth portions is of the same size.

9. The venting device according to claim 1, wherein one mold half of the venting device is driven linearly parallel to a mold parting line of the two mold halves.

* * * * *